US006036607A

United States Patent [19]

Finegan

[11] Patent Number: 6,036,607

[45] Date of Patent: Mar. 14, 2000

[54] ADJUSTABLE GRIP

[76] Inventor: Christopher H. Finegan, 431 Morris Ave., Rockville Centre, N.Y. 11570

[21] Appl. No.: 09/033,301

[22] Filed: Mar. 2, 1998

[51] Int. Cl.[7] ..... A63B 53/14

[52] U.S. Cl. ..... 473/206; 473/300

[58] Field of Search ..... 473/300–303, 473/520, 521, 523, 568, 298, 299, 200, 201, 202, 203, 204, 206

[56] References Cited

U.S. PATENT DOCUMENTS

| | | | |
|---|---|---|---|
| 1,617,972 | 2/1927 | Wallace | 473/299 |
| 1,632,227 | 6/1927 | Halsey . | |
| 1,890,037 | 12/1932 | Johnson | 473/300 |
| 1,942,922 | 1/1934 | Gerow . | |
| 2,221,421 | 11/1940 | Curry | 473/300 |
| 2,481,778 | 9/1949 | Pearson . | |
| 2,690,338 | 9/1954 | de Brocke . | |
| 2,984,486 | 5/1961 | Jones . | |
| 3,806,130 | 4/1974 | Jacques . | |
| 4,361,326 | 11/1982 | Kokes . | |
| 4,662,415 | 5/1987 | Proutt . | |
| 4,861,034 | 8/1989 | Lee . | |
| 4,878,667 | 11/1989 | Tosti . | |
| 5,069,454 | 12/1991 | Frost . | |
| 5,274,846 | 1/1994 | Kolsky | 2/460 |
| 5,299,802 | 4/1994 | Bouchet-Lassale . | |
| 5,439,217 | 8/1995 | Ganger, Sr. . | |
| 5,478,083 | 12/1995 | Foster, II . | |
| 5,511,445 | 4/1996 | Hildebrandt . | |
| 5,524,885 | 6/1996 | Heo | 473/299 |
| 5,577,722 | 11/1996 | Glassberg | 473/457 |
| 5,611,533 | 3/1997 | Williams | 473/300 |
| 5,637,043 | 6/1997 | Fortis | 473/302 |
| 5,749,792 | 5/1998 | Engfer | 473/300 |
| 5,857,929 | 1/1999 | Huang | 473/302 |

*Primary Examiner*—Jeanette Chapman
*Assistant Examiner*—Stephen L. Blau
*Attorney, Agent, or Firm*—Roylance, Abrams, Berdo & Goodman, L.L.P.

[57] ABSTRACT

A grip for an elongated shaft, especially a golf club, having a main portion with an inner surface, an outer surface opposite to said inner surface, an upper end, a lower end opposite said upper end, a first side, and a second side opposite said first side. Each of the inner and outer surfaces extend between the first and second ends and between the first and second sides. The main portion has a thickness extending between the inner and outer surfaces that gradually tapers in a first direction from a thickened area adjacent the upper end to a thinner area adjacent the lower end. A first fastener is coupled to the inner surface and a second fastener is coupled to the outer surface. The main portion is movable between an open position wherein the first and second fasteners are spaced from each other and a closed position wherein the first and second fasteners are releasably attached. The main portion forms a hollow, substantially tubular member open at both the upper end and the lower end when the main portion is in the closed position. The grip is preferably used on an elongated shaft such as a golf club, and is preferably used in combination with an existing, permanent grip.

17 Claims, 5 Drawing Sheets

ADJUSTABLE GRIP

FIELD OF THE INVENTION

The invention relates generally to a grip that is removably secured to a shaft and selectively adjustable along the length of the shaft. More specifically, the invention relates to an adjustable golf club grip that can be removably secured to a golf club having a conventional, permanent grip already secured thereto. The adjustable grip of the invention can be selectively placed at various locations along the length of the shaft of the club to permit a user of the club to securely and properly grasp the club below the permanent grip, i.e., closer to the clubhead.

BACKGROUND OF THE INVENTION

Typically, as young children begin playing golf, they are too small to use regular-sized, i.e., adult-sized, golf clubs. Even junior-sized golf clubs, if they are available, may be too large for young children, or too small for older children or young adults. Therefore, when practicing or playing golf, young children often must use golf clubs that are too long. This often requires an improper gripping of the golf club. In particular, the golf club is improperly gripped by both hands grasping the uncovered metal or graphite shaft instead of the permanent grip intended to be grasped. Alternatively, the golf club is improperly gripped by one hand or a portion thereof grasping the permanent grip of the golf club while a second hand or a portion thereof grasps the uncovered metal or graphite shaft.

Although various grips and gripping aids for have been developed, none of the prior art devices satisfy the above-mentioned problems.

Examples of prior art grips and gripping aids are disclosed in the following U.S. Pat. Nos. 1,632,227 to Halsey; 1,942,922 to Gerow; 2,481,778 to Pearson; 2,690,338 to De Brocke; 2,984,486 to Jones; 3,806,130 to Jacques; 4,361,326 to Kokes; 4,662,415 to Proutt; 4,861,034 to Lee; 4,878,667 to Tosti; 5,069,454 to Frost; 5,299,802 to Bouchet-Lassale; 5,439,217 to Ganger, Sr.; 5,478,083 to Foster, II; and 5,511,445 to Hildebrandt.

Thus, there is a continuing need to provide adjustable grips that enable users to selectively hold an elongated shaft at various positions along the shaft, especially where that shaft is already provided with a permanent grip. This invention addresses these needs in the art as well as other needs, which will become apparent to those skilled in the art once given this disclosure.

SUMMARY OF THE INVENTION

One object of the present invention is to provide an adjustable grip for an elongated shaft.

Still another object of the invention is to provide an adjustable grip that is removably replaceable at different positions along the length of an elongated shaft.

Yet another object of the invention is to provide an adjustable grip for use with a golf club having a permanent grip.

A further object of the invention is to provide an adjustable grip to allow a user who is prohibited by height or desire from gripping an elongated shaft at its permanent grip, to properly hold the shaft at a location other than at its permanent grip.

Still a further object of the invention is to provide a method of adjusting the holding position of an elongated shaft, especially a golf club.

The foregoing objects are basically attained by providing a grip for an elongated shaft comprising a main portion having a first surface, a second surface opposite to the first surface, a first free end, a second free end opposite the first free end, a first side, and a second side opposite the first side, each of the first and second surfaces extending between the first and second ends and between the first and second sides, the main portion having a thickness extending between the first and second surfaces, the thickness gradually tapering in a first direction from a first area adjacent the first end to a second area adjacent the second end with the thickness being greater at the first area than at the second area; a first fastener coupled to the first surface; and a second fastener coupled to the second surface, the main portion being movable between an open position wherein the first and second fasteners are spaced from each other and a closed position wherein the first and second fasteners are releasably attached, the main portion forming a hollow, substantially tubular member being open at both the first end and the second end when the main portion is in the closed position.

The foregoing objects are also attained by providing a gripping assembly, comprising a shaft having a first portion and a second portion; an elongated first permanent grip having a first section and a second section, the first permanent grip being rigidly coupled to and substantially surrounding only the first portion of the shaft; and a second grip having a main portion and first and second fasteners coupled to the main portion, the second grip being removably coupled to and substantially surrounding only the second section of the first permanent grip and being removably coupled to and substantially surrounding the second portion of the shaft, the second grip being movable between an open position wherein the first and second fasteners are spaced from each other and a closed position wherein the first and second fasteners are releasably attached.

The foregoing objects are further attained by providing a method of adjusting a holding portion of an elongated shaft, comprising the steps of providing an elongated shaft having a longitudinal axis, a first portion and a second portion; providing a first permanent grip having a first section and a second section, the first permanent grip being rigidly coupled to and substantially surrounding only the first portion of the shaft; providing a second grip, securely attaching the second grip to a first position on both the first permanent grip and the shaft with the second grip substantially surrounding the second section of the first permanent grip and substantially surrounding the second portion of the shaft; and removing the second grip from the first permanent grip and the shaft; and securely attaching the second grip to a second position on the first permanent grip and on the shaft, the second position being axially displaced relative to the first position along the longitudinal axis of the shaft.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
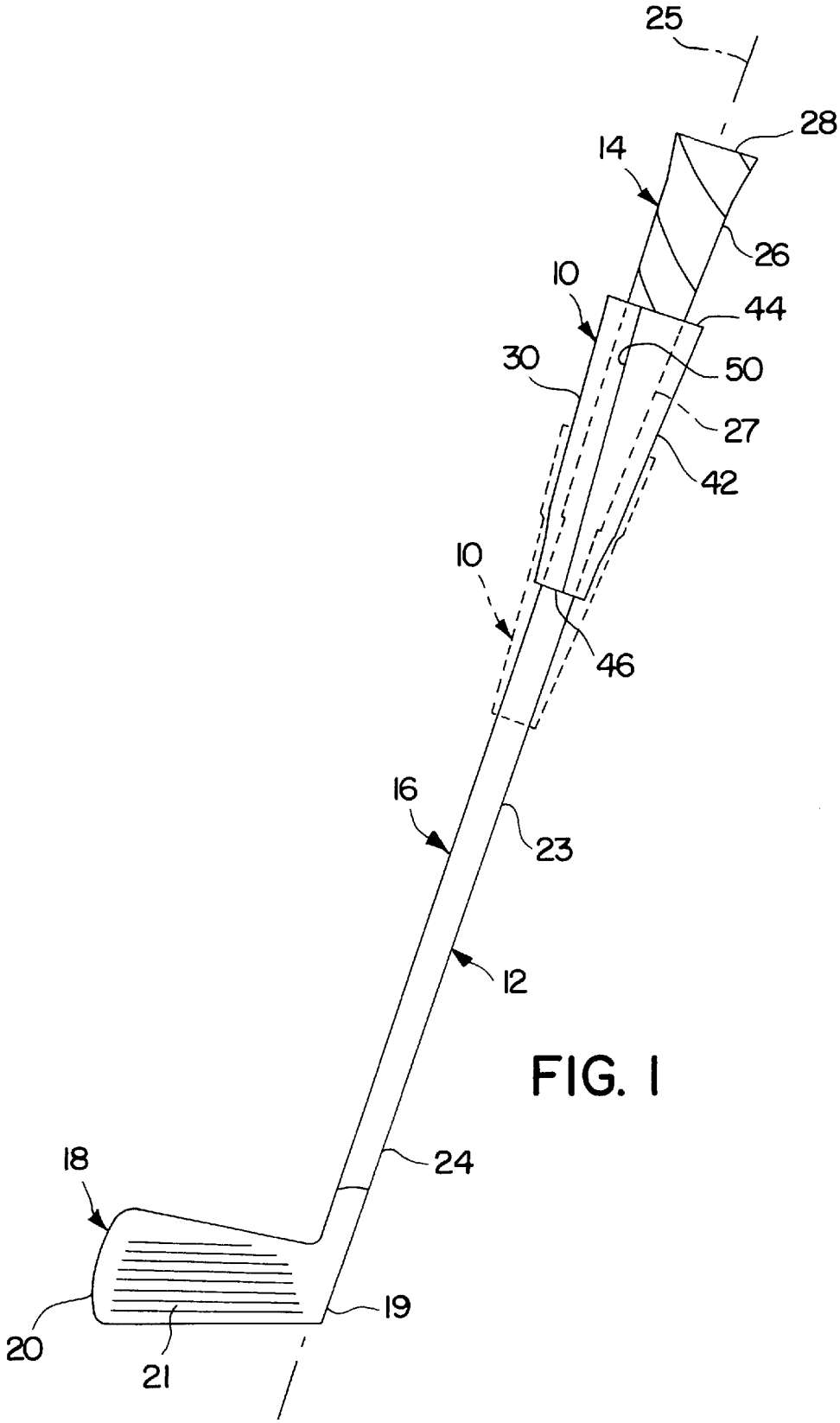
FIG. 1 is a front elevational view illustrating a golf club having an adjustable grip in accordance with the present invention attached thereto, a first possible location of the adjustable grip is illustrated in solid lines and a second possible location of the adjustable grip is illustrated in dashed lines.

As seen in FIG. 1, an adjustable grip 10 in accordance with the present invention is selectively attached to an elongated shaft, such as a golf club 12.

Golf club 12 has a permanent grip 14, an elongated shaft 16, and a clubhead 18. Golf club 12 is a conventional golf club as is known in the art and, therefore, will not be described in great detail herein. Preferably permanent grip 14, shaft 16, and clubhead 18 are formed as defined by The Rules of Golf as approved by The United States Golf Association and The Royal and Ancient Golf Club of St. Andrews, Scotland (hereinafter "The Rules of Golf"). That is, permanent grip 14 preferably consists of the part of the shaft and the material added to it designed to be held by the golfer for the purpose of obtaining a firm hold, and is preferably straight and plain in form, extends to the end of said shaft 16, and is not molded for any part of the hands of the user. Shaft 16 is preferably straight, with the same bending and twisting properties in any direction, and is attached to said clubhead 18 at the heel 19 of said clubhead 18 either directly or through a single plain neck and/or socket. Clubhead 18 is preferably plain in shape, has only one striking surface (unless it is a putter, which can have two opposite striking surfaces with similar characteristics), and the distance from said heel 19 to the toe 20 of said clubhead 18 is greater than the distance from the face 21 of said clubhead 18 to the back. of said clubhead 18, which is opposite to said face 21. Although, The Rules of Golf are subject to change at any time, said golf club 12 is preferably in conformance to the current set of The Rules of Golf, whatever they become. Additionally, The Rules of Golf as approved by The United States Golf Association and The Royal and Ancient Golf Club of St. Andrews, Scotland, Copyright 1997 by The United States Golf Association are incorporated herein by reference.

Figure 4:
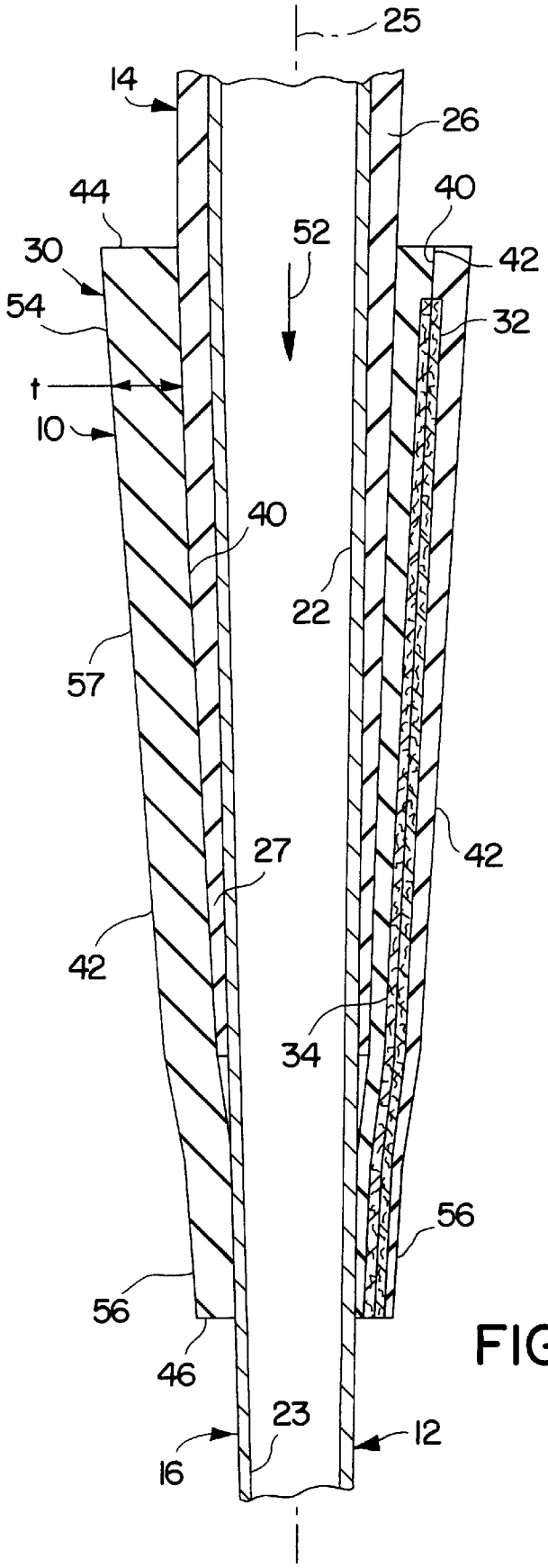
FIG. 4 is a cross-sectional view of the golf club and the adjustable grip in accordance with the present invention attached thereto, taken along line 4—4 of FIG. 3.

Elongated shaft 16 of golf club 12 has a gripping portion 22, a middle portion 23, a clubhead connecting portion 24, and a longitudinal axis 25. As with conventional golf clubs, and as seen in FIG. 4, elongated shaft 16 decreases in diameter, or in width tansverse to the longitudinal axis 52, along longitudinal axis 52 from the gripping portion 22 of the shaft 16 adjacent the upper section 26 of the permanent grip 14 to the middle portion 23 of the shaft 16. Elongated shaft 16 can be formed of any acceptable, conventional material, including metal and composite material.

Permanent grip 14 has an upper section 26 and a lower section 27, and is substantially rigidly attached to gripping portion 22 of shaft 16 as is known in the art. Permanent grip 14 completely surrounds gripping portion 22 of shaft 16. Permanent grip 14 is a conventional golf club grip as is known in the art, and is made from conventional golf club grip material. For example, permanent grip 14 can be made from leather, natural rubber, or an elastomer, such as synthetic rubbers, including ethylene-propylene-diene monomer (EPDM) and thermoplastic elastomers (TPE).

Figure 2:
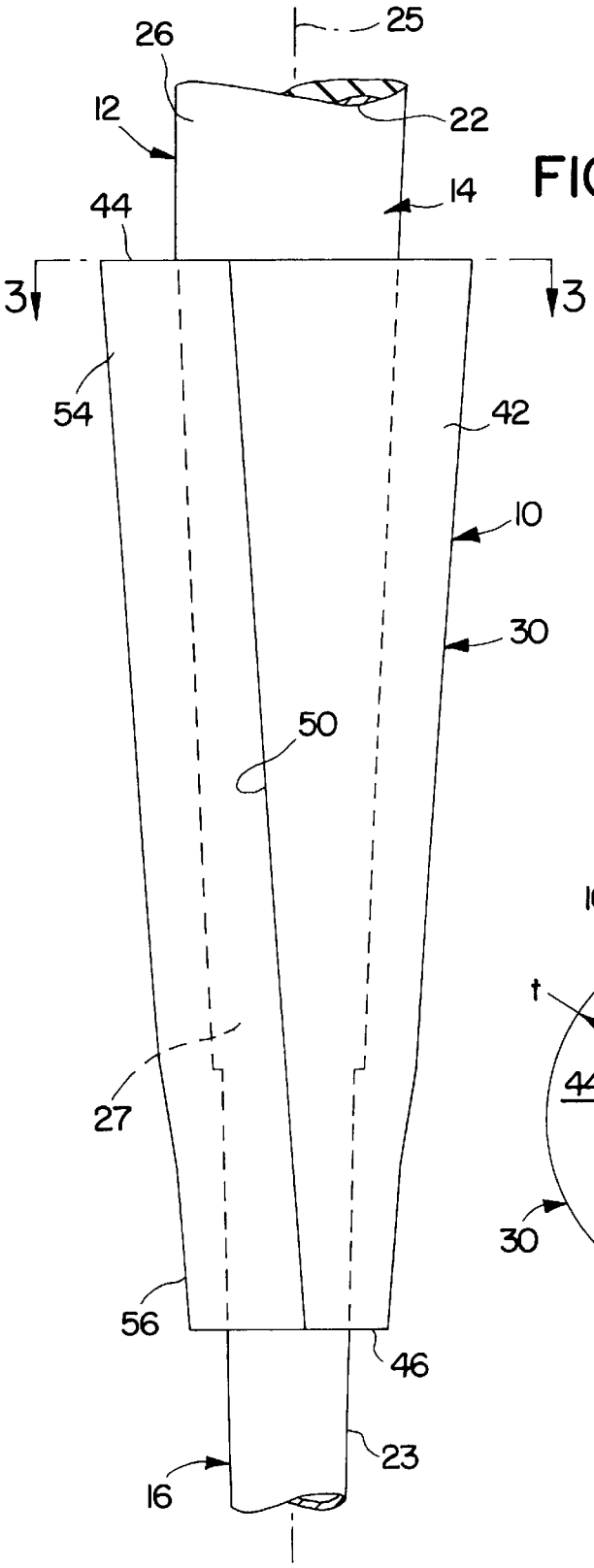
FIG. 2 is an enlarged, partial view of the golf club and an enlarged view of the adjustable grip in accordance with the present invention attached thereto as illustrated in FIG. 1.
Figure 3:
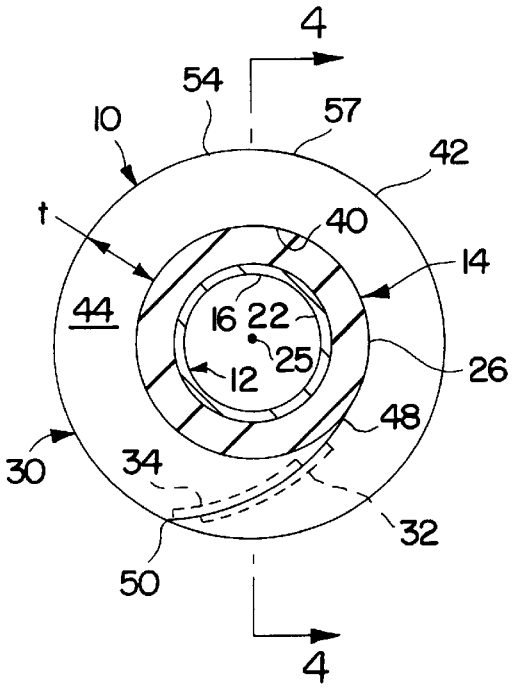
FIG. 3 is a cross-sectional plan view of the golf club and a plan view of the adjustable grip in accordance with the present invention attached thereto, taken along line 3—3 of FIG. 2.
Figure 8:
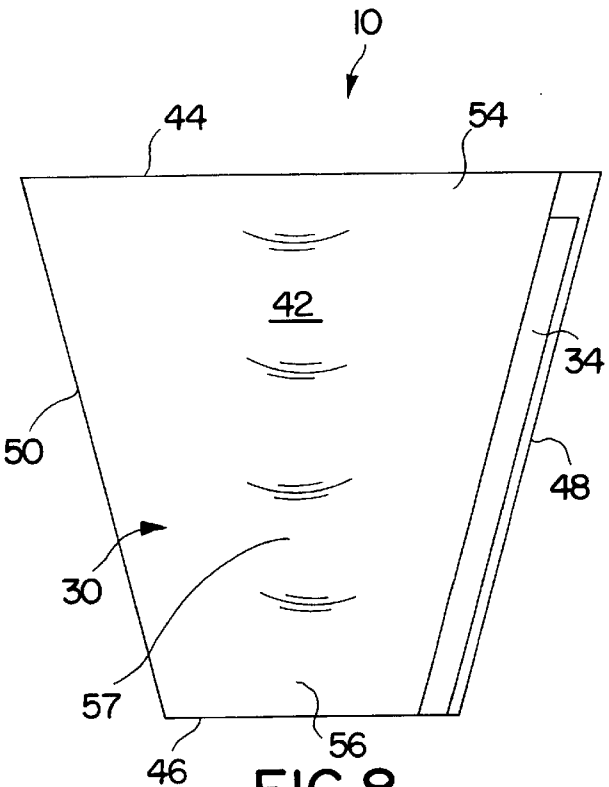
FIG. 8 is a rear elevational view of the adjustable grip of the present invention in the open position.
Figure 5:
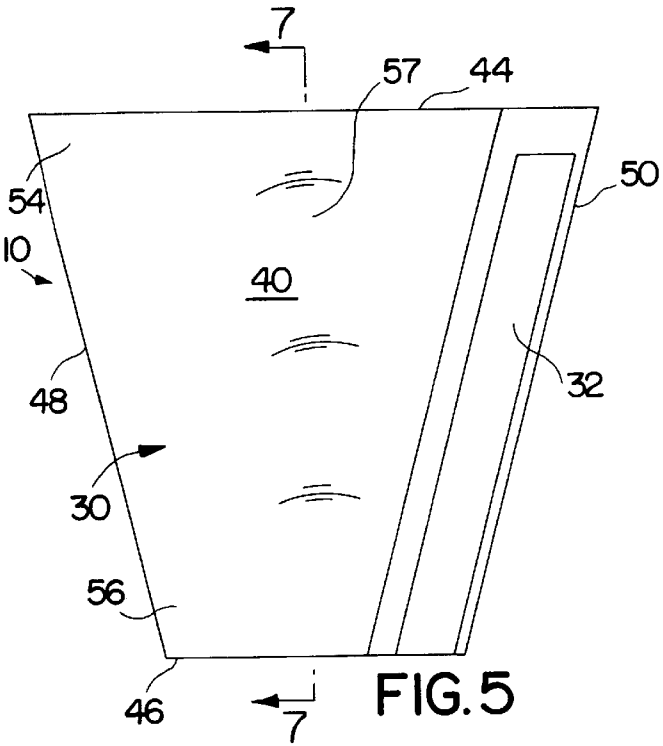
FIG. 5 is a front elevational view of the adjustable grip in accordance with the present invention in an open position.
Figure 6:
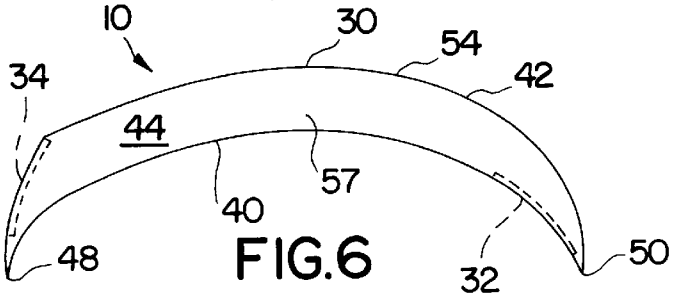
FIG. 6 is a plan view of the adjustable grip in accordance with the present invention in the open position.

Adjustable grip 10 has a main portion 30, an inner fastener 32, and an outer fastener 34. Inner and outer fasteners 32 and 34 removably secure main portion 30 to golf club 12 and maintain adjustable grip 10 in a closed position as illustrated in FIG. 1 when fasteners 32 and 34 are attached to each other. Fasteners 32 and 34 engage each other when main portion 30 is folded on top of itself in an overlapping manner as seen in FIGS. 1–3 and discussed below. When inner and outer fasteners 32 and 34 are spaced from one another, adjustable grip 10 is in an open position as illustrated in FIGS. 5, 6 and 8.

Main portion 30 has an inner surface 40 and an outer surface 42. The two surfaces 40 and 42 are opposite to each other. The perimeters of inner surface 40 and outer surface 42 form an upper end 44, a lower end 46, a first side 48, and a second side 50. Surfaces 40 and 42 can take many shapes, but preferably each is substantially trapezoidal in shape, as seen in FIGS. 5 and 8.

Main portion 30 is preferably a integral piece of material, formed of one-piece, unitary construction. Main portion 30 can be formed of a variety of materials, each having a variety of characteristics. Preferably, main portion 30 is formed of material that is substantially identical to the material that forms permanent grip 14. That is, main portion 30 is preferably formed of leather, natural rubber, or an elastomer, such as synthetic rubbers, including ethylene-propylene-diene monomer (EPDM) and thermoplastic elastomers (TPE). Further, main portion 30 preferably has a density that is substantially identical to that of permanent grip 10. Thus, adjustable grip 10 will conform to the sections of golf club 12 to which it is attached, but provide a substantially smooth outer surface 43. Preferably, by making adjustable grip 10 from material that is substantially identical to that used for permanent grip 14, the user of adjustable grip 10 will have the same "feel" and comfort when using adjustable grip 10 as when using permanent grip 14 by itself, in a conventional manner.

Additionally, main portion 30 is formed so that it is biased towards the closed position. That is, when main portion 30 is in the open position as seen in FIGS. 5–8, it will return towards the closed position when no forces are acting on main portion 30 to maintain main portion 30 in the open position. Thus, main portion 30 is substantially resilient and will return to its original closed position, or a position substantially resembling its original closed position, after being forced to the open position, and having those forces removed. This feature facilitates securing adjustable grip 10 on golf club 12, and enables a more secure and conforming attachment with permanent grip 14.

Main portion 30 has a thickness "t" extending between inner surface 40 and outer surface 42. Preferably, thickness "t" decreases along the length of main portion 30 in a downward direction 52 from a thickened area 54 adjacent upper end 44 to a thinner area 56 adjacent lower end 46. Although the tapering of thickness "t" can take various forms, the tapering is preferably constant. This tapering of thickness "t" of main portion 30 will further tighten adjustable grip 10 on golf club 12 and, therefore, help prevent adjustable grip 10 from rotating.

Figure 7:
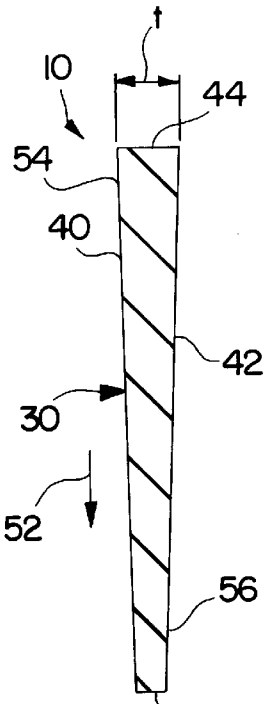
FIG. 7 is a cross-sectional view of the adjustable grip in accordance with the present invention, taken along line 7—7 of FIG. 5.

As seen in FIG. 7, in the open position, inner surface 40 is preferably substantially straight in longitudinal cross-section. Outer surface 42 is also substantially straight in longitudinal cross-section, but converges towards inner surface 40 as outer surface 42 extends from upper end 44 towards lower end 46. Preferably, outer surface 42 converges with a constant slope towards lower end 46 of inner surface 40.

It should be understood that the thickness "t" of main portion 30 along the length of main portion 30 between upper free end 44 and lower free end 46 can take various forms. For example, portions of thickness "t" can be constant along the length of main portion 30, that is, inner surface 40 and outer surface 42 can be substantially parallel in cross-section. Further, thickness "t" can be greater adjacent lower end 46 than adjacent upper end 44 (not shown), if it is desired to maintain a continuously smooth outer surface 42 that is straight in longitudinal cross-section after being attached to golf club 12. In other words, the section of main portion 30 adjacent lower end 46 can be thickened where it is intended to cover only shaft 16 and be stepped to a thinner area where main portion 30 is intended to cover permanent grip 14. This enables inner surface 40 of main portion 30 to generally conform to the shape of golf club 12, while outer surface 42 is substantially smooth and straight in longitudinal cross section. Alternatively, thickness "t" can vary, producing undulations (not shown) in main portion 30.

As seen in FIGS. 3 and 6, main portion 30 also preferably tapers toward sides 48 and 50. Although main portion 30 can take various forms and shapes, it is preferably thickest in its central area 57, equidistant from first and second sides 48 and 50. Preferably, main portion 30 tapers toward each side 48 and 50. The tapering of main portion 30 towards sides 48 and 50 allows sides 48 and 50 to mate in a substantially flush relationship as illustrated in FIG. 3. Further, the tapering of main portion 30 toward sides 48 and 50 permits sides 48 and 50 to form a substantially flush connection resulting in a substantially smooth outer surface 42 when adjustable grip 10 is secured around golf club 12. Although the precise position of adjustable grip 10 along the length of shaft 16 will determine the position of sides 48 and 50 relative to each other and whether or not they are substantially flush, adjustable grip can be designed for placement at a preferred location on shaft 16 resulting in a substantially flush connection between sides 48 and 50. In other words, since permanent grip 14 is thicker at its butt end 28, if adjustable grip 10 is positioned closely to butt end 28, sides 48 and 50 may be slightly spaced in the closed position. Of course, the relative positioning of sides 48 and 50 when adjustable grip 10 is in the closed position depends on the size of main portion 30, which can vary as needed or desired.

Fasteners 32 and 34 can be any fasteners that adequately secure sides 48 and 50 of main portion 30 in an overlapping manner in the closed position around golf club 12. Ideally, fasteners 32 and 34 are of the releasable type so that adjustable grip 10 can be removably secured at various selected positions along the length of shaft 16. Preferably, fasteners 32 and 34 are of the well-known hook-and-loop type fasteners, such as VELCRO. In such case, one of fasteners 32 and 34 can be the hook fastener, while the other of fasteners 32 and 34 can be the loop fastener. Preferably, inner fastener 32 is the hook fastener and outer fastener 34 is the loop fastener. This allows the smoother loop fastener surface to face the hand of the user if the loop fastener is not completely covered by the hook fastener. As seen in FIGS. 3, 4 and 6, preferably, each fastener 32 and 34 is received within a recess in main portion 30. This further aids in forming a substantially flush connection between sides 48 and 50.

When adjustable grip 10 is in the closed position, but not placed around a shaft such as shaft 16, main portion 30 forms a hollow, substantially tubular member that is open at both upper end 44 and lower end 46 when main portion 30 is in the closed position.

As seen in FIG. 1, in use, adjustable grip 10 is preferably secured to golf club 12 so that a lower section 27 of permanent grip 14 is covered by upper end 44 of adjustable grip 10. The securing of adjustable grip 10 is accomplished by fasteners 32 and 34 being coupled together. The length of adjustable grip 10 allows it to extend along the length of shaft 16, in the direction of axis 24, and cover a part of middle portion 23 of shaft 16. In other words, adjustable grip 14 can cover both a portion of permanent grip 25 and a portion of shaft 16 that was not previously covered by any gripping material. This allows a user to now properly hold golf club 12 at a position along the length of shaft 16 not previously capable of being properly held or gripped, i.e., along the portion of shaft 16 previously not covered by gripping material. Adjustable grip 10 is securely fastened in this position to effect a relatively rigid connection between adjustable grip 10 and golf club 12, allowing the user to grasp adjustable grip 10 and use golf club 12 effectively while playing or practicing golf. The rationale for the user wanting to hold golf club 12 below the permanent grip 14, towards clubhead 18 can vary, for instance, it can be for lack of physical height, or simply the desire to do so for increased control or other reasons.

As a practical matter, adjustable grip 10 will generally extend over at least some part of middle portion 23 of shaft 16 not previously covered by gripping material, for example, at least two inches. An expected range of positioning of upper end 44 of adjustable grip 10 is between a point approximately two inches below butt end 28 or free end of permanent grip 14 and a point approximately two inches above the end of permanent grip 14 closest to clubhead 18. However, if a thickened grip area is needed, adjustable grip 10 can be positioned entirely on permanent grip 14. Alternatively, if it is desired to hold golf club 12 very close to clubhead 18, for whatever reason, adjustable grip 10 can be positioned entirely on middle portion 23 of shaft 16 over an area that previously had no gripping material.

If, for instance, a second user found it necessary to grasp golf club 12 at a position closer to clubhead 18 than the position that adjustable grip 10 was originally placed, adjustable grip 10 is easily detached from its original position (illustrated in solid lines in FIG. 1). This is accomplished by separating fasteners 32 and 34 and moving adjustable grip 10 to a new position (e.g., indicated in dashed lines in FIG. 1). Adjustable grip 10 is then secured once again to shaft 16 through the use of fasteners 32 and 34 again forming a relatively rigid connection with shaft 16. It should be understood that, if desired or necessary, adjustable grip 10 can be located anywhere along shaft 16, including completely on permanent grip 14 or completely spaced from and not covering any portion of permanent grip 14. Since adjustable grip 10 does not damage golf club 12 in any way, it is easily removed from golf club 12 and golf club 12 can be used as intended, without adjustable grip 10, when the user has grown sufficiently.

SECOND EMBODIMENT

Figure 9:
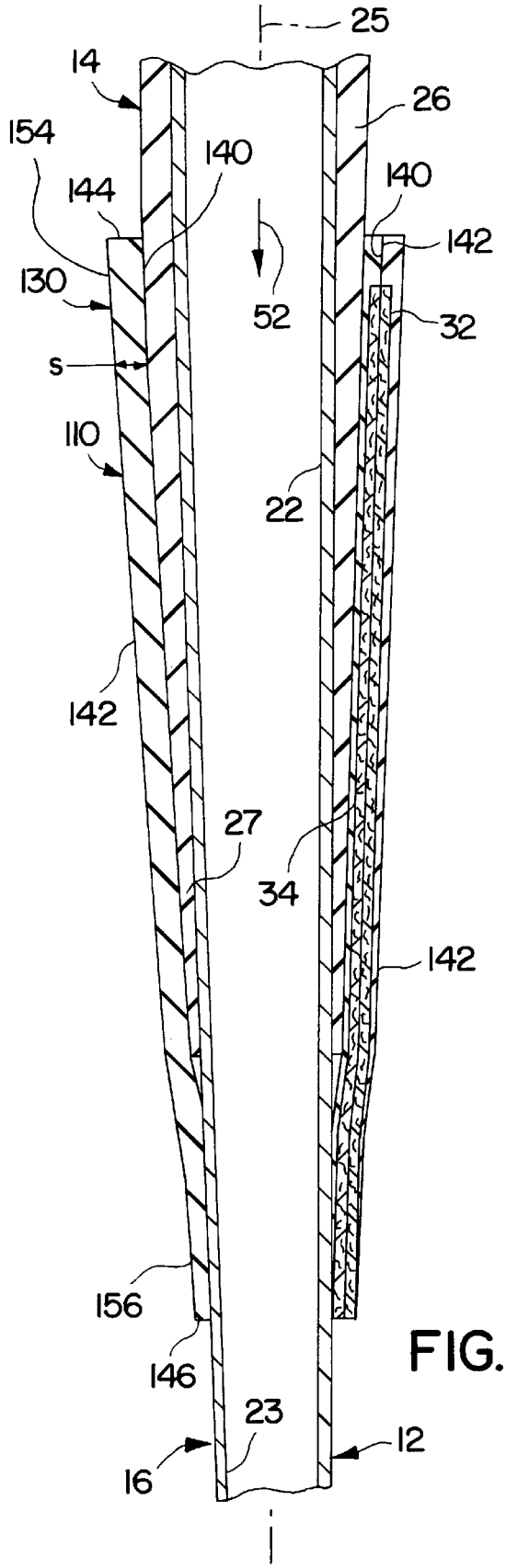
FIG. 9 is a cross-sectional view, similar to FIG. 4, illustrating the golf club and an adjustable grip in accordance with a second embodiment of the present invention attached thereto.

Referring to FIG. 9, an adjustable grip 110 in accordance with a second embodiment of the invention is illustrated. Adjustable grip 110 attaches to golf club 12 in a substantially identical manner as described above with respect to adjustable grip 10. Further, adjustable grip 110 is substantially identical to adjustable grip 10 discussed above except for its thickness "s".

Adjustable grip 110 has a main portion 130, an inner fastener 132, and an outer fastener 134. Main portion 130 has an inner surface 140 and an outer surface 142. The perimeters of inner surface 140 and outer surface 142 form an upper end 144, a lower end 146, a first side 148, and a second side 150.

In adjustable grip 110, thickness "s" tapers from a thickened area 154 to a thinner area 156. The thinner area being adjacent to lower end 146. At lower end 146, the thickness "s" is substantially equivalent to only the thickness of the two fasteners 32 and 34. Main portion 130 tapers in a substantially identical manner as main portion 30 of adjustable grip 10, but the section of main portion 130 adjacent fasteners 32 and 34 terminates higher relative to longitudinal axis 24 towards upper end 144 than that of adjustable grip 10. Adjustable grip 110 enables a thinner grip to be formed, thus, further facilitating use by users with smaller hands.

Although adjustable grips 10 and 110 have been described as being used in connection with golf club 12, it should be understood that adjustable grips 10 and 110 are not limited to use only with golf clubs or the like. Adjustable grips 10 and 110 can be used in any number of applications and for use on any number of elongated shafts, especially to aid in gripping the shafts or in thickening the handle portion of the shafts. For example, adjustable grips 10 and 110 can be used with other sporting equipment, such as tennis rackets, and with any number of tools, such as hammers.

While advantageous embodiments have been chosen to illustrate the invention, it will be understood by those skilled in the art from this disclosure that various changes and modifications can be made therein without departing from the scope of the invention as defined in the appended claims.

What is claimed is:

1. A grip for an elongated shaft comprising:

a main portion having a first surface, a second surface opposite to said first surface, a first free end, a second free end opposite said first free end, a fir side, and a second side opposite said first side, each of said first and second surfaces extending between said first and second ends and between said first and second sides, sad main portion having a thickness extending between said first and second surfaces, said thickness gradually tapering in a first direction from a first area adjacent said first end to a second area adjacent said second end with said thickness being greater at said first area than at said second area;

a first fastener coupled to said first surface; and a second fastener coupled to said second surface, said main portion being movable between an open position wherein said first and second fasteners are spaced from each other and a closed position wherein said first and second fasteners are releasably attached, said main portion forming a hollow, substantially tubular member being open at both said first end and said second end when said main portion is in said closed position, said thickness of said member gradually tapering in said first direction at a constant slope, said thickness of said member further gradually tapering in a deceasing manner in a second direction towards said first side and in a third direction in a decreasing manner towards said second side such that in a said closed position said first side is substantially flush with said first surface, and said first surface being an outer surface when said main portion is in said closed position.

2. A grip according to claim 1, wherein one of said first and second fasteners is a hook-type fastener and the other of said first and second fasteners is a loop-type fastener.

3. A grip according to claim 2, wherein said main portion is an integral, one-piece member formed entirely of natural rubber or an elastomer.

4. A grip according to claim 3, wherein each of said first and second surfaces are substantially trapezoidal in shape when said main portion is in said open position.

5. A grip according to claim 4, wherein said main portion is formed of a ethylene-propylene-diene monomer.

6. A gripping assembly, comprising:

an elongated shaft having a first portion and a second portion;

an elongated first permanent grip having a first section and a second section, said fit permanent grip being rigidly coupled to and substantially surrounding only said first portion of said shaft; and a second grip having a main portion and first and second fasteners coupled to said main portion, said second grip being removably coupled to and substantially surrounding only said second section of said first permanent grip and being removably coupled to and substantially surrounding said second portion of said shaft, said second grip being moved between an open position wherein said first and second fasteners are spaced from each other and a closed position wherein said first and second fasteners are releasably attached, said second grip further having a first surface, a second surface opposite to said first surface, a first free end, a second free end opposite said first fee end, a first side, and a second side opposite said first side, each of said first and second surfaces extending between said first and second ends and between said first and second sides, said main portion having a thickness extending between said first and second surfaces along substantially the entire length of sad second grip, said thickness gradually tapering from a first area adjacent said first end to a second area adjacent said second end with said thickness being greater at said first area than at said second area.

7. A gripping assembly according to claim 6, wherein said first permanent grip is formed of a first material and said second grip is formed of a second material, and said first material is substantially identical to said second material.

8. A gripping assembly according to claim 7, wherein each of said first and second materials is natural rubber or an elastomer.

9. A gripping assembly according to claim 7, wherein each of said first and second materials is an ethylene-propylene-diene monomer.

10. A gripping assembly according to claim 7, wherein said first permanent grip has a first density and said second grip has a second density, and said first density is substantially identical to said second density.

11. A gripping assembly, comprising:

an elongated shaft having a first portion and a second portion;

an elongated first permanent grip having a first section and a second section, said first permanent grip being rigidly coupled to and substantially surrounding only said first portion of said shaft; and a second grip having a main portion and first and second fasteners coupled to said main portion, said second grip ben removably coupled to and substantially surrounding only said second section of said first permanent grip and being removably coupled to and substantially surrounding said second portion of said shaft said second grip being movable between an open position wherein said first and second fasteners are spaced from each other and a closed position wherein said first and second fasteners are releasably attached, said first permanent grip being formed of a first material and said second grip being formed of a second material, and said first material being substantially identical to said second material, each of said fir and second materials is leather.

12. A gripping assembly, comprising:

an elongated shaft having a first portion and a second portion;

an elongated first permanent grip having a first section and a second section, said first permanent grip being rigidly coupled to and substantially surrounding only said first portion of said shaft; and a second grip having a main portion and first and second fasteners coupled to said main portion, said second grip being removably coupled to and substantially surrounding only said second section of said first permanent grip and being removably coupled to and substantially surrounding said second portion of said shaft, said second grip being movable between an open position wherein said lust and second fasteners are spaced from each other and a closed position wherein said first and second fasteners are releasably attached, said second grip further having a first survey a second surface opposite to said first surface, a first free end, a second free end opposite said first be end, a first side, and a second side opposite said first side, each of said first and second surfaces extending between said first and second ends and between said first and second sides, said main portion having a thickness extending between said first and second surface, said thickness gradually tapering from a first area adjacent said first end to a second area adjacent said second end with said thickness being greater at said first area than at said second area, said first fastener being coupled to said first surface, said second fastener being coupled to said second surface, said main portion forming a substantially tubular member with said elongated shaft extending completely through said main portion between said first end and said second end when said main portion is in said closed position.

13. A gripping assembly according to claim 12, wherein said thickness of said member gradually tapers at a constant slope.

14. A gripping assembly according to claim 12, wherein said shaft is a part of a golf club.

15. A method of adjusting a holding portion of an elongated shaft, comprising the steps of:

providing an elongated shaft having a longitudinal axis, a first portion and a second portion;

providing a first permanent grip having a first section and a second section, said first permanent grip being rigidly coupled to and substantially surrounding only said first portion of said shaft;

providing a second grip;

securely attaching said second grip to a first position on both said first permanent grip and said shaft with said second grip substantially surrounding said second section of said first permanent grip and substantially surrounding said second portion of said shaft; and removing said second grip from said first permanent grip and said shaft; and securely attaching said second grip to a second position on said first permanent grip and on said shaft, said second position being axially displaced relative to said first position along said longitudinal axis of said shaft.

16. A method according to claim 15, wherein said step of providing said second grip further comprises said second grip having a main portion with a first surface, a second surface opposite to said first surface, a first free end, a second free end opposite said first free end, a first side, and a second side opposite said first side, each of said first and second surfaces extending between said first and second ends and between said first and second sides, said main portion having a thickness extending in a first direction between said first and second surfaces, said thickness gradually tapering from a first area adjacent said first end to a second area adjacent said second end with said thickness being greater at said first area than at said second area, a first fastener coupled to said first surface, and a second fastener coupled to said second surface, said main portion being movable between an open position wherein said first and second fasteners are not in contact with each other and a closed position wherein said first and second fasteners are releasably attached, said main portion forming a substantially tubular member with said elongated shaft extending completely through said main portion between said first end and said second end when said main portion is in said closed position, and said elongated shaft is a part of a golf club.

17. A grip for an elongated shaft, comprising:

a main portion having a first surface, a second surface opposite to said first surface, a first free end, a second See end opposite said first free end, first side, and a second side opposite said first side, each of said first and second surfaces extending between said first and second ends and between said first and second sides, said mm portion having a thickness tending between said first and second surfaces, said thickness gradually tapering in a first direction from a first area adjacent said first end to a second area adjacent said second end with said thickness being greater at said first area t at said second area;

a first fastener coupled to said first surface; and a second fastener coupled to said second surface, said main portion being movable between an open position wherein said first and second fasteners are spaced from each other and a closed position wherein said first and second fasteners are releasably attached, said main portion forming a hollow, substantially tubular member being open at both said first end and said second end when said main portion is in said closed position, said thickness of said member fiber gradually tapering in a decreasing manner in one of a second direction towards said first side or a third direction towards said second side.

* * * * *